US011493298B2

(12) United States Patent
Magee

(10) Patent No.: US 11,493,298 B2
(45) Date of Patent: Nov. 8, 2022

(54) FIREARM SUPPRESSOR HAVING CONCENTRIC BAFFLE CHAMBERS

(71) Applicant: Todd A. Magee, Farmington, UT (US)

(72) Inventor: Todd A. Magee, Farmington, UT (US)

(73) Assignee: Sound Moderation Technologies, LLC, Raleigh, NC (US)

( * ) Notice: Subject to any disclaimer, the term of this patent is extended or adjusted under 35 U.S.C. 154(b) by 0 days.

(21) Appl. No.: 17/282,689

(22) PCT Filed: Oct. 14, 2019

(86) PCT No.: PCT/US2019/054874
§ 371 (c)(1),
(2) Date: Apr. 2, 2021

(87) PCT Pub. No.: WO2020/081268
PCT Pub. Date: Apr. 23, 2020

(65) Prior Publication Data

US 2021/0381791 A1 Dec. 9, 2021

Related U.S. Application Data

(60) Provisional application No. 62/742,140, filed on Oct. 5, 2018.

(51) Int. Cl.
*F41A 21/30* (2006.01)
*F41A 21/32* (2006.01)

(52) U.S. Cl.
CPC ..... *F41A 21/30* (2013.01)

(58) Field of Classification Search
CPC ..... F41A 21/30; F41A 21/32
See application file for complete search history.

(56) References Cited

U.S. PATENT DOCUMENTS 4,588,043 A * 5/1986 Finn ..... F41A 21/30 89/14.4
6,575,074 B1 * 6/2003 Gaddini ..... F41A 21/30 89/14.4
7,308,967 B1 * 12/2007 Hoel ..... F41A 21/30 181/255
7,587,969 B2 * 9/2009 Silvers ..... F41A 21/30 42/1.06
7,987,944 B1 * 8/2011 Brittingham ..... F41A 21/30 89/14.4

(Continued)

*Primary Examiner* — Derrick R Morgan
(74) *Attorney, Agent, or Firm* — Charmasson, Buchaca & Leach, LLP

(57) ABSTRACT

A firearm suppressor (1) also known as a moderator includes a number of coaxially joined steel baffles (20,40,60) for dissipating discharge gasses. Each baffle can have an internal funnel structure (30) having a central aperture (31) through which the firearm projectile passes. Adjacent funnel structures form interconnected primary and secondary chambers connected by a port (28) through a flange (37) separating the chambers. A notch (36) in the central aperture of one funnel structure directs flow toward the port (48) on the diametrically opposite side of the next funnel structure. A radial hole (29) through the funnel structure connects successive primary and secondary chambers. The flange is axially located to be radially inward from an overlapping joint between two adjacent baffles in order to provide structural support to the joint.

26 Claims, 4 Drawing Sheets

(56) References Cited

U.S. PATENT DOCUMENTS

| | | | | |
|---|---|---|---|---|
| 8,100,224 | B1 * | 1/2012 | Olson | F41A 21/30 181/267 |
| 9,239,201 | B1 * | 1/2016 | Reis Green | F41A 21/30 |
| 10,267,586 | B1 * | 4/2019 | Marfione | F41A 21/30 |
| 10,502,512 | B1 * | 12/2019 | Beaudry | F41A 21/28 |
| 10,648,756 | B2 * | 5/2020 | Mooty | F41A 21/30 |
| 11,054,207 | B2 * | 7/2021 | Martin | F41A 21/28 |
| 11,255,623 | B2 * | 2/2022 | Kras | F41A 21/30 |
| 2012/0103176 | A1 * | 5/2012 | Latka | F41A 21/325 89/14.4 |
| 2014/0224574 | A1 * | 8/2014 | Latka | F41A 21/30 181/223 |
| 2014/0224575 | A1 * | 8/2014 | Latka | F41A 21/30 156/60 |
| 2014/0299405 | A1 * | 10/2014 | Miller | F41A 21/30 181/223 |
| 2016/0018179 | A1 * | 1/2016 | Morris | F41A 21/30 181/223 |
| 2016/0202013 | A1 * | 7/2016 | Lessard | F41A 21/325 89/14.05 |
| 2017/0321984 | A1 * | 11/2017 | Palu | F41A 21/34 |
| 2018/0172383 | A1 * | 6/2018 | James | F41A 21/30 |
| 2018/0252489 | A1 * | 9/2018 | Parker | F41A 21/30 |
| 2019/0063859 | A1 * | 2/2019 | Gilpin | F41A 21/30 |
| 2020/0025494 | A1 * | 1/2020 | Parker | F41A 21/30 |
| 2021/0199401 | A1 * | 7/2021 | Magee | F41A 21/30 |

* cited by examiner

FIREARM SUPPRESSOR HAVING CONCENTRIC BAFFLE CHAMBERS

PRIOR APPLICATION

This application claims the benefit of U.S. Provisional Patent Application Ser. No. 62/742,140, filed 2018 Oct. 5, incorporated herein by reference.

FIELD OF THE INVENTION

The instant invention relates to firearm sound suppressors and more particularly to muzzle-mounted, multi-chamber devices for dissipating firearm discharge gasses that accompany a projectile.

BACKGROUND

Firearms such as guns have long been in use for hunting, target shooting, and as weapons. The sound associated with the discharge of gasses out the muzzle of a firearm, known as the report, can be very loud, often at levels damaging to the hearing of persons nearby including the operator firing the firearm. Sound suppressors, known more colloquially as silencers, have been used for decades on many types of firearms from pistols to high power rifles to reduce the sound level of the report.

One type of suppressor, as shown in Gaddini, U.S. Pat. No. 6,575,074 incorporated herein by reference, uses a series of cylindrical, axially connected baffle structures mounted at the discharging end of a firearm muzzle. The firearm projectile travels down a central cylindrical bore through the axially arranged baffles. Radially outward from the bore are a series of interconnected expansion chambers for capturing and slowing the discharge gasses accompanying and following the projectile. The chambers allow the pressure of the captured gasses to slowly dissipate within the suppressor. By the time the gasses are released from the suppressor, they are traveling at such a slow speed that their sound, and thus the loudness of the report, is greatly reduced.

Various problems are encountered by baffle-type suppressors. In order to achieve maximum sound attenuation, the suppressor may need to be very long, increasing weight and cost, and be specifically dimensioned for the type of ammunition being used. Some suppressors can only accommodate low pressure ammunition such as in some pistol and rimfire type firearms.

Some prior suppressors, such as Reis Green, U.S. Pat. No. 9,239,201 can suffer from high backpressure during rapid firing when pressurized gasses flow back into the muzzle which can trap energy in the firearm, increasing heat, and reducing muzzle velocity. Such designs can create a cross-jet, accentuated by the slit in the cone, that traps gas which flows backward into the muzzle when a pathway opens during part of the firing cycle of a repeating firearm.

In some suppressors a radially peripheral chamber spanning the length of the suppressor can allow unwanted backpressure to form.

Further, certain baffle shapes may be suited to firearms in which the projectile has a certain range of shapes and dimensions, is traveling within a certain range of velocities, and/or the discharge gasses have a certain volume or are traveling within a certain range of velocities. For example, a baffle design suited to a large caliber pistol may not be suited to a smaller caliber, high powered rifle.

Many prior suppressors require a central bore that closely matches the caliber of the projectile. This can increase manufacturing costs by requiring tighter tolerances, and can also lead to higher gas pressures that tend to deflect the trajectory of the projectile, leading to inaccuracies, and even unwanted contact between the projectile and baffle cones.

Therefore, there is a need for a firearm suppressor which addresses some or all of the above identified inadequacies.

SUMMARY

The principal and secondary objects of the invention are to provide an improved firearm suppressor. These and other objects are achieved by dual, discrete interconnected chambers between adjacent baffles.

In some embodiments there is provided a firearm suppressor for dissipating energy from discharge gasses as a result of a discharge by a firearm, said suppressor comprises: a first baffle comprising a first funnel structure; a second baffle comprising a second funnel structure; wherein said first and second baffles are joined end-to-end; wherein said first funnel structure comprises: a proximal end and a distal end; a central aperture near said proximal end; a notch extending radially through said first funnel structure; said notch being located at a first angular position adjacent to said aperture; wherein said second funnel structure comprises: a circumferential flange extending radially outward from a medial section of said second funnel structure; and, a port extending axially through said circumferential flange at a second angular position.

In some embodiments said first and second angular positions are different from one another.

In some embodiments said suppressor further comprises a hole extending radially through said second funnel at a third angular position different from said second angular position.

In some embodiments said hole is located axially distal to said flange.

In some embodiments said first angular position is about 180 degrees separated from said second angular position; and wherein said third angular position is about 180 degrees separated from said second angular position.

In some embodiments said first and second baffles are substantially identically shaped and dimensioned.

In some embodiments said suppressor further comprises: a third baffle comprising a third funnel structure; wherein said third baffle is joined end-to-end to said first baffle; and, wherein said circumferential flange is located at an axial position aligned with an overlap joint between said third baffle and said first baffle.

In some embodiments a periphery of said circumferential flange contacts an inner surface of said first funnel structure.

In some embodiments a gap is formed between a periphery of said circumferential flange and an inner surface of said first funnel structure.

In some embodiments said suppressor further comprises: said third baffle comprising a distal extent; and, said proximal end being located proximal to an axial position of said distal extent.

In some embodiments said first funnel structure comprises: a widening section extending distally from said proximal end; and, a narrowing section extending distally from said widening section.

In some embodiments said second funnel structure further comprises: a skirt; and, a tubular spacer comprising a proximal lip contacting said skirt and a distal lip contacting said second baffle.

In some embodiments there is provided a firearm suppressor for dissipating energy from discharge gasses as a result of a discharge by a firearm, said suppressor comprises: a first baffle comprising a first outer tube section and a first funnel; a second baffle comprising a second outer tube section and a second funnel; wherein said first and second outer tube sections are joined end-to-end; wherein said first funnel further comprises: a proximal end and a distal end; a central aperture at said proximal end; a notch extending radially through said first funnel; said notch being located at a first angular position adjacent to said aperture; wherein said second funnel further comprises: a circumferential flange extending radially outward from a medial section of said second funnel; a port extending axially through said circumferential flange at a second angular position; and, a hole extending radially through said second funnel at a third angular position.

In some embodiments said first angular position is about 180 degrees separated from said second angular position.

In some embodiments said third angular position is about 180 degrees separated from said second angular position.

In some embodiments said first and second baffles are substantially identically shaped and dimensioned.

In some embodiments said suppressor further comprises: a third baffle comprising a third outer tube section and a third funnel; wherein said third outer tube section is joined end-to-end to said first outer tube section; and wherein said circumferential flange is located at an axial position commensurate with a overlap joint between said third outer tube section and said second outer tube section.

In some embodiments there is provided a firearm suppressor for dissipating energy from discharge gasses as a result of a discharge by a firearm, said suppressor comprises: a first baffle comprising a first outer tube section and a first funnel; a second baffle comprising a second outer tube section and a second funnel; a third baffle comprising a third outer tube section and a third funnel; wherein said first, second, and third outer tube sections are joined sequentially end-to-end; wherein said third funnel comprises: a proximal end; a distal end sealed to said third outer tube section; wherein said proximal end is located proximal to an axial position of a distal extent of said first outer tube section.

In some embodiments said suppressor further comprises: said third funnel further comprising: a circumferential flange extending radially outward from a medial section of said third funnel; a port extending axially through said circumferential flange; and, wherein said circumferential flange is located at an axial position commensurate with a overlap joint between said first outer tube section and said second outer tube section.

In some embodiments said suppressor further comprises a radial hole through said funnel axially distal to said flange.

In some embodiments said hole is located diametrically opposite said port.

In some embodiments said suppressor further comprises: a central aperture at said proximal end.

In some embodiments said suppressor further comprises: a radial notch in said funnel adjacent to said aperture.

In some embodiments said notch is located diametrically opposite said port.

In some embodiments an axial position of said proximal end is more proximally located than an axial position of a distal extent of said third baffle.

In some embodiments said first, second and third baffles are similarly shaped and dimensioned.

In some embodiments there is provided a firearm suppressor for dissipating energy from discharge gasses as a result of a discharge by a firearm, said suppressor comprises: a first baffle; a second baffle; a third baffle; wherein said first, second, and third baffles are joined coaxially and sequentially to form a stack; wherein said first baffle comprises: an outer tube section; a funneling structure which comprises: a proximal end and a distal end; a central aperture at said proximal end; said distal end sealed to said outer tube section; a circumferential flange extending radially outward from a medial section of said funneling structure; a port extending axially through said circumferential flange; and, wherein said circumferential flange is located at an axial position radially inward from a joint between said second and third baffles.

In some embodiments there is provided a firearm suppressor for dissipating energy from discharge gasses as a result of a discharge by a firearm, said suppressor comprises: a first baffle; a second baffle; a third baffle; wherein said first, second, and third baffles are joined coaxially and sequentially to form a stack; an outer tube surrounding said stack; wherein said first baffle comprises: a section of said outer tube; a funneling structure which comprises: a skirt comprising a proximal end and a central aperture at said proximal end; a tubular spacer comprising a proximal lip contacting said skirt and a distal lip contacting said second baffle; said skirt having a circumferential flange extending radially outward to contact said section of said outer tube; a port extending axially through said circumferential flange; and, a hole extending radially through said tubular spacer.

In some embodiments said hole is located diametrically opposite said port.

In some embodiments said circumferential flange comprises and axially thickened flair at its radial periphery.

In some embodiments said tubular spacer has a substantially truncated right circular cone shape wherein said proximal lip is diametrically smaller than said distal lip.

In some embodiments there is provided the combination of a bullet and a suppressor baffle, wherein said bullet comprises a cylindrical outer surface; said suppressor baffle comprises: wherein said baffle comprises: an outer tube section; a funneling structure which comprises: a proximal end and a distal end; a central aperture at said proximal end commensurate with said outer surface; said distal end sealed to said outer tube section; a circumferential flange extending radially outward from a medial section of said funneling structure; a port extending axially through said circumferential flange; and, a hole extending radially through said funnel axially distal to said flange.

In some embodiments said hole is located diametrically opposite said port.

In some embodiments there is provided a method for suppressing the report of a firearm, said method comprises: gaseously propelling a projectile linearly through at least three axially and successively aligned baffles; wherein a third one of said baffles comprises a funnel structure extending axially past a first one of said baffles.

In some embodiments there is provided a method for suppressing the report of a firearm, said method comprises: gaseously propelling a projectile linearly through at least two axially and successively aligned baffles; wherein a first one of said baffles comprises a first funnel structure comprising: a proximal end and a distal end; a central aperture at said proximal end; a notch extending radially through said first funnel; said notch being located at a first angular position adjacent to said aperture; wherein a second one of said baffles comprises said second funnel comprising: a circumferential flange extending radially outward from a medial section of said second funnel; a port extending axially through said circumferential flange at a second angular position opposite said first angular position; and, a hole extending radially through said second funnel at a third angular position angularly separated from said second angular position.

The original text of the original claims is incorporated herein by reference as describing features in some embodiments.

DESCRIPTION OF THE EXEMPLARY EMBODIMENTS

Figure 1:
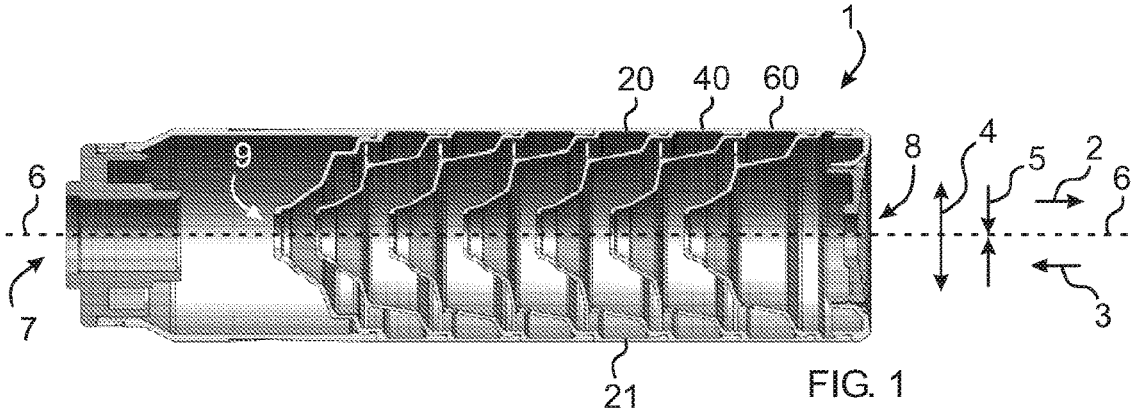
FIG. 1 is a diagrammatic cross-sectional side view of a firearm suppressor according to an exemplary embodiment of the invention.
Figure 2:
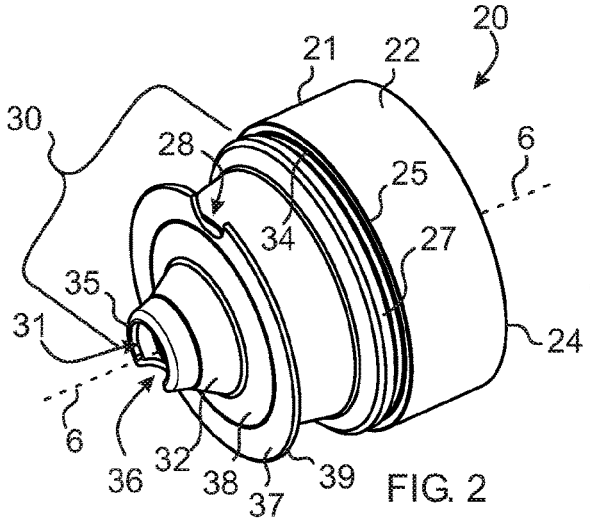
FIG. 2 is a diagrammatic top-back-right perspective view of a single baffle taken from the suppressor of FIG. 1.
Figure 3:
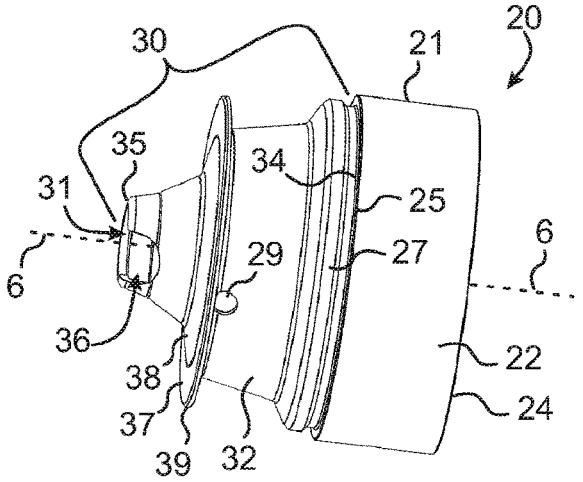
FIG. 3 is a diagrammatic bottom-back-right perspective view of the single baffle FIG. 2.
Figure 4:
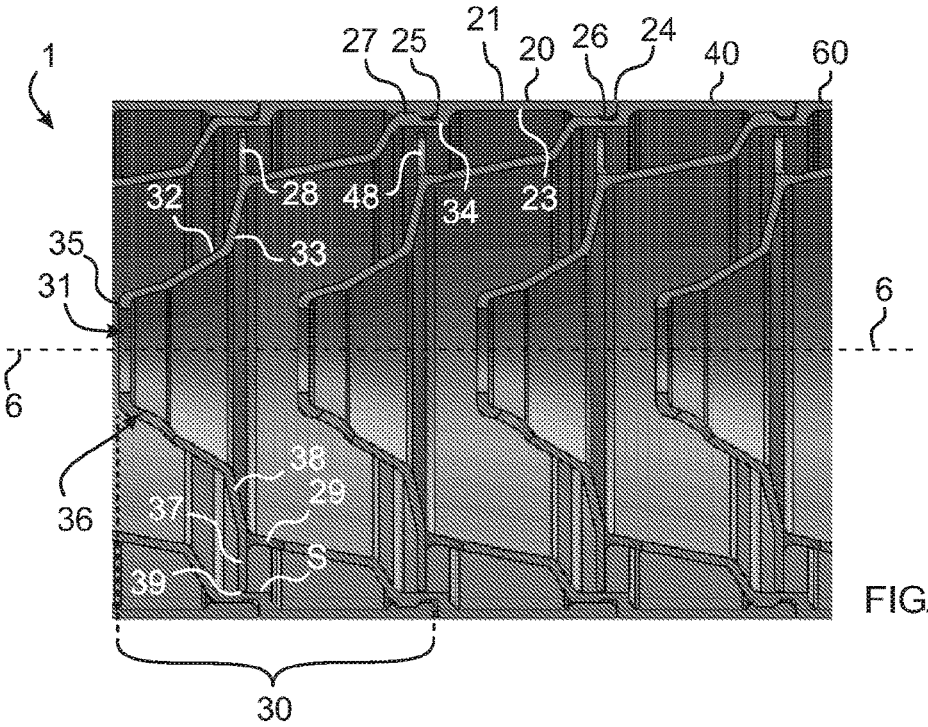
FIG. 4 is an enlarged diagrammatic cross-sectional side view of the suppressor of FIG. 1.

In this specification the terms "distal" and "forward", and "proximal" and "rearward" are used to indicate relative axial positioning with respect to the suppressor and the travel of a projectile. The projectile always travels distally or forwardly from the rear or back of the suppressor toward its front. Proximal or rearward is the opposite direction from distal. As shown in FIG. 1, the distal direction is indicated by arrow 2; the proximal direction is indicated by arrow 3; the radially outward direction is indicated by arrow pair 4; and, the radially inward direction is indicated by arrow pair 5. The term "axial" is meant to refer to the dimension along or in the direction of the axis.

The term "substantially" is used in this specification because manufacturing imprecision and inaccuracies can lead to non-symmetricity and other inexactitudes in the shape, dimensioning and orientation of various structures. Further, certain geometrical shapes are given as a guide to the generally describe the function of various structures. The term "substantially" is used to make slight departures from exact geometrical shapes, but which operate in a similar fashion. Those skilled in the art will readily appreciate the degree to which a departure can be made from the mathematically exact shape.

Referring now to the drawing, there is shown in FIG. 1 a suppressor 1 according to an exemplary embodiment of the invention. The suppressor can have a central bore 9 which extends along an axis 6 from a proximal inlet 7 which can attach to the muzzle of a firearm and a distal outlet 8 from which exits a fired projectile. During firing a projectile or bullet moves distally through the bore. The suppressor can include a series of substantially identically shaped and dimensioned baffles 20,40,60 (for example) axially interconnected in an end-to-end manner to form a baffle stack. Each baffle can be made from a unitary piece of solid, hard, strong, durable material such as stainless steel. A pair of interconnected baffles form a pair of discrete chambers between them for capturing high pressure and high temperature gasses, and allowing them to cool and reduce in pressure before exiting the distal outlet.

As shown in FIGS. 1-4, a first baffle 20 can include an outer tube section 21 which can have a substantially cylindrical outer surface 22 and a substantially cylindrical inner surface 23. The outer tube section has a distal extent 24 and an opposite proximal extent 25. Female threads 26 can be formed into the inner surface near the distal extent of the outer tube section.

The baffle 20 includes a funnel structure 30 which, in general, extends distally and radially outwardly from a proximal end 35 to a distal end 34. However, in some sections, as will be described below, the funnel structure may extend cylindrically or radially inwardly as it extends distally. The funnel structure has an inner surface 33 and an outer surface 32. The distal end of the funnel structure can be sealed to the proximal extent 25 of the outer tube section 21.

Male threads 27 can be formed into the outer surface 32 of the funnel structure 30 near its distal end 34 where it seals to the outer tube section 21. The threads are shaped and dimensioned to cooperatively engage the female threads 26 in a neighboring baffle in the stack while the baffles are joined together. Although threaded attachment of the baffles to one another is shown, other types of fittings such as snap fittings, friction fittings, or even welds can be used.

The proximal end 35 of the funnel structure 30 includes a central substantially circular aperture 31 having a diameter selected to allow intimate axial passage of the projectile therethrough, forming part of the central bore of the suppressor. Optionally, an angular notch 36 can be formed substantially radially through the funnel as an extension of the aperture. The notch allows gasses that have built up to create a cross-jet across the bore path in the next more distal chamber which would impede the back flow of gasses out of the chamber. This cross jet also helps prevent gasses from the primary chamber from immediately proceeding forward through the bore. This builds pressure in the primary chamber to direct gasses radially outwardly and forward toward the distal and radially outward wedge portion of the primary chamber.

A circumferential flange 37 can extend radially outwardly from a medial section 38 of the outer surface 32 of the funnel structure 30. The dimension of the circumferential flange can be selected so that its outer periphery 39 has an outer diameter slightly less than an inner diameter of a substantially cylindrical inner surface section S near the distal end 34 of the inner surface 33 of the funnel structure. In this way, the flange can intimately engage the inner surface section of a neighboring funnel structure to separate adjoining primary and secondary chambers as will be described below. A port 28 extends axially through the flange connecting primary and secondary chambers as will be described below. The size and number of ports can be selected to allow for channeling gasses more rapidly. A hole 29 extends radially through the funnel structure distal to the flange to allow for a discharge of backpressure gasses as will be described below.

Figure 5:
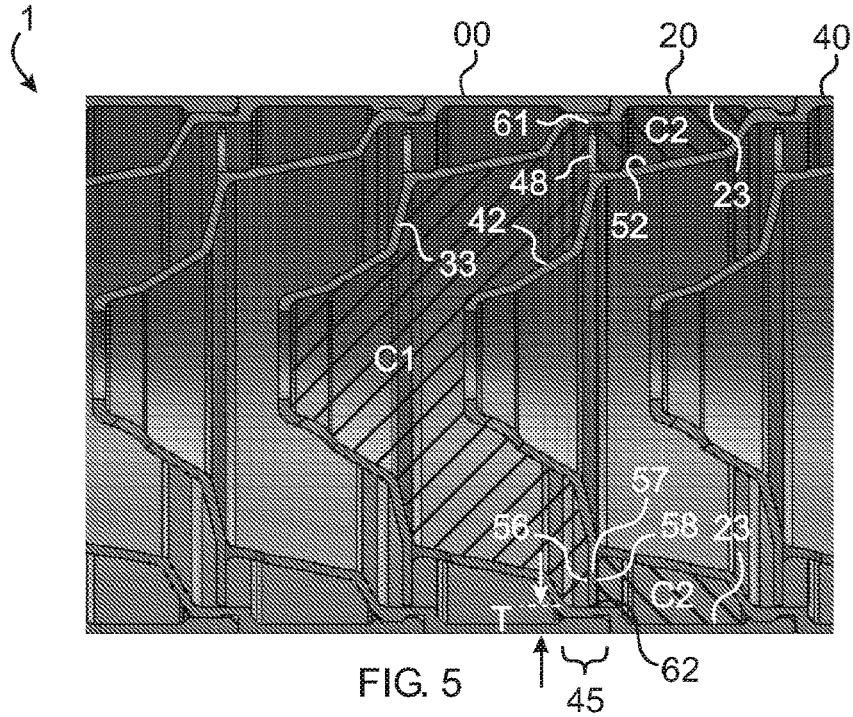
FIG. 5 is an enlarged diagrammatic cross-sectional side view of the suppressor of FIG. 1 showing the dual discrete chambers between joined baffles.

As shown in FIG. 5, where two neighboring baffles 20,40 are joined, the inner surfaces 23,33 of the first baffle 20, and the outer surface sections 42,52 of the funnel structure of the neighboring, second baffle 40 form an interacting pair of discrete chambers, namely a central, primary chamber C1, and a peripheral, secondary chamber C2, both of which cooperate to trap and dissipate the high pressure discharge gasses.

The primary chamber C1 is bordered by the inner surface 33 of the funnel structure of the first baffle 20, a proximal outer surface section 42 of the funnel structure of the second baffle 40, and the proximally facing surface 56 of the circumferential flange 57 of the second baffle.

The secondary chamber C2 is bordered by the inner surface 23 of the outer tube section of the first baffle 20, a distal outer surface section 52 of the funnel structure of the second baffle 40, and the distally facing surface 58 of the circumferential flange 57 of the second baffle.

It is important to note that it is the port 48 through the circumferential flange 57 of the second baffle 40 that primarily connects the primary chamber C1 with the secondary chamber C2 even though there can be a slight peripheral gap 61 in some angular locations between the outer periphery of the circumferential flange and the inner surface of the funnel structure of the neighboring baffle. Further, the flange can be dimensioned so that its periphery intimately contacts 62 the inner surface of the neighboring baffle. Further, each baffle in the baffle stack can be angularly aligned with the other baffles so that all of the apertures are in substantial angular alignment.

The port 48 can be located at an angular position different from the angular position of the notch 26 and different from the angular position of the hole 29. Further, the port can be angularly located diametrically opposite from the angular position of the notch so that in baffles that have been properly angularly aligned, hot, high pressure initial gasses are directed toward the port and into the secondary chamber. Further, the hole 29 can be located at an angular position that is diametrically opposite the port so that gasses in the secondary chamber have a more circuitous route into and eventually out of the secondary chamber and into the next more distal primary chamber, giving time for those gasses to cool and depressurize. In this way, the angular position of the port can be separated about 180 degrees from the angular position of the notch. Similarly, the angular position of the port can be separated about 180 degrees from the angular position of the hole.

The correspondingly engaged male and female threads form an overlap region 45 between adjoining baffles 00,20. The overlap region can provide a radially layered overlap joint of thickened material having a thickness T which enhances its stiffness and strength with respect to the forces delivered by pressurized gasses during firing. It is important to note that the overlap joint can be located axially to be in axial alignment with the flange 57 of the next most distal baffle 40. This location at the distal terminus of the primary chamber C1 endures some of the highest gas pressures. Thus the thickened material of the overlap joint provides added strength and stiffness where it is needed most. This allows less material overall in the suppressor, decreasing weight and cost.

Figure 6:
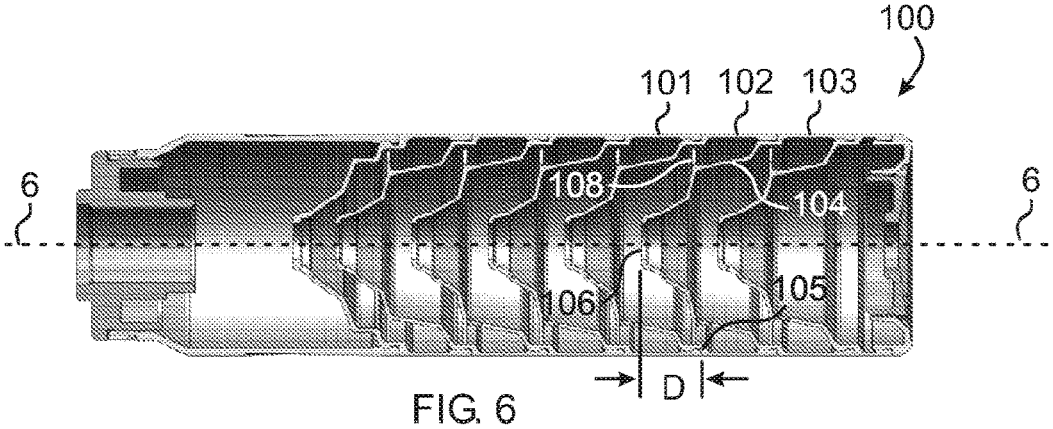
FIG. 6 is a diagrammatic cross-sectional side view of the suppressor of FIG. 1 showing axial overlap of baffles.

The baffles can be shaped and dimensioned so that the proximal end of the funnel of one baffle is located at an axial position which is proximal to the axial position of the distal extent of the outer tube section of the baffle proximal to its proximal neighbor. In other words, as shown in FIG. 6, where three baffles 101,102,103 have been joined to form a stack 100, the funnel aperture 106 of the third baffle 103 is located proximal to the distal extent 105 of the outer tube section of the first baffle 101. In yet other words, a positive axial distance D exists between the proximal end of the funnel of a distal baffle 103 and the distal extent of a proximal baffle 101 separated from the distal baffle by an intermediate baffle 102. This allows the funnel 104 to be axially longer while still being adequately supported by the circumferential flange 108 contacting the second baffle 102. This enhances baffle strength while still allowing an elongated funnel, and hence elongated channels, which allow more gradual dissipation of pressure, reducing shock and the report.

Figure 7:
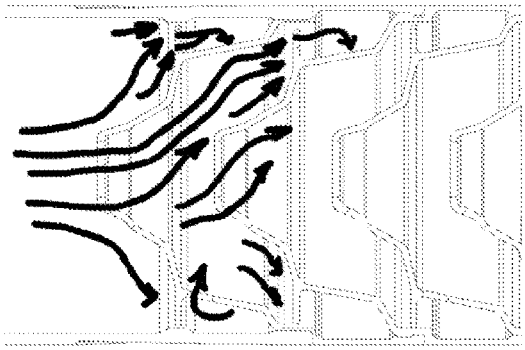
FIG. 7 is an enlarged diagrammatic cross-sectional side view of the suppressor of FIG. 1 showing flows of gasses during firing.
Figure 8:
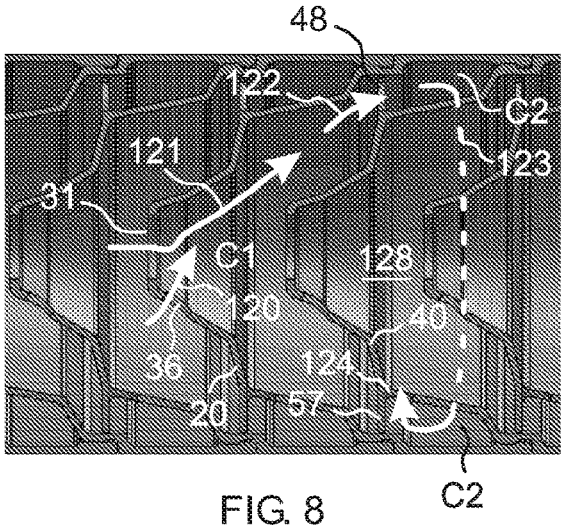
FIG. 8 is an enlarged diagrammatic cross-sectional side view of the suppressor of FIG. 1 showing specified flows of gasses during firing.

Referring now to FIGS. 7-8, there is shown in FIG. 7 a diagrammatic flow of gasses as indicated by arrows in a typical firing of a projectile through the suppressor. As shown in FIG. 8, gasses flowing 120 through the notch 36 in a first baffle 20 help deflect the flow 121 of gasses entering the aperture 31 toward the port 48 in the circumferential flange 57 of the distally adjacent baffle 40. High pressure gasses then flow 122 from a primary chamber C1 through the port and into a secondary chamber C2. The gasses then flow 123 circumferentially through the secondary chamber from the port 48 to the diametrically opposite part of the secondary chamber where and exit through the hole 124 in the funnel of the distally adjacent baffle 40 and into the next successive primary chamber 128.

Figure 9:
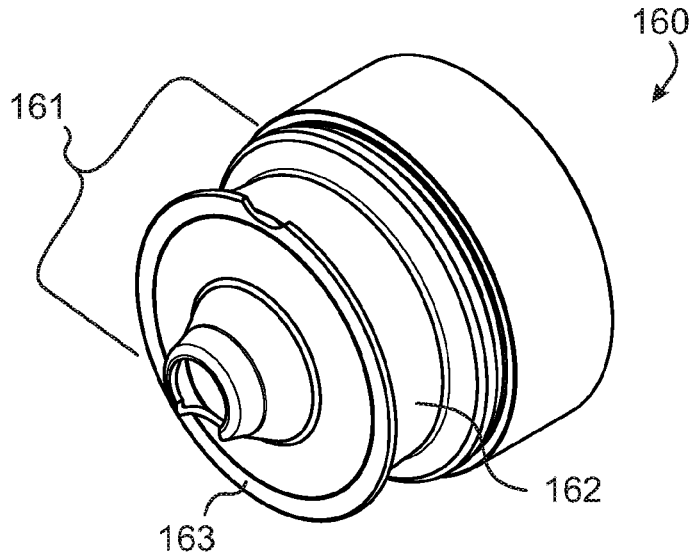
FIG. 9 is a diagrammatic top-back-right perspective view of a single baffle according to an alternate exemplary embodiment of the invention having a distally tapering funnel section.
Figure 10:
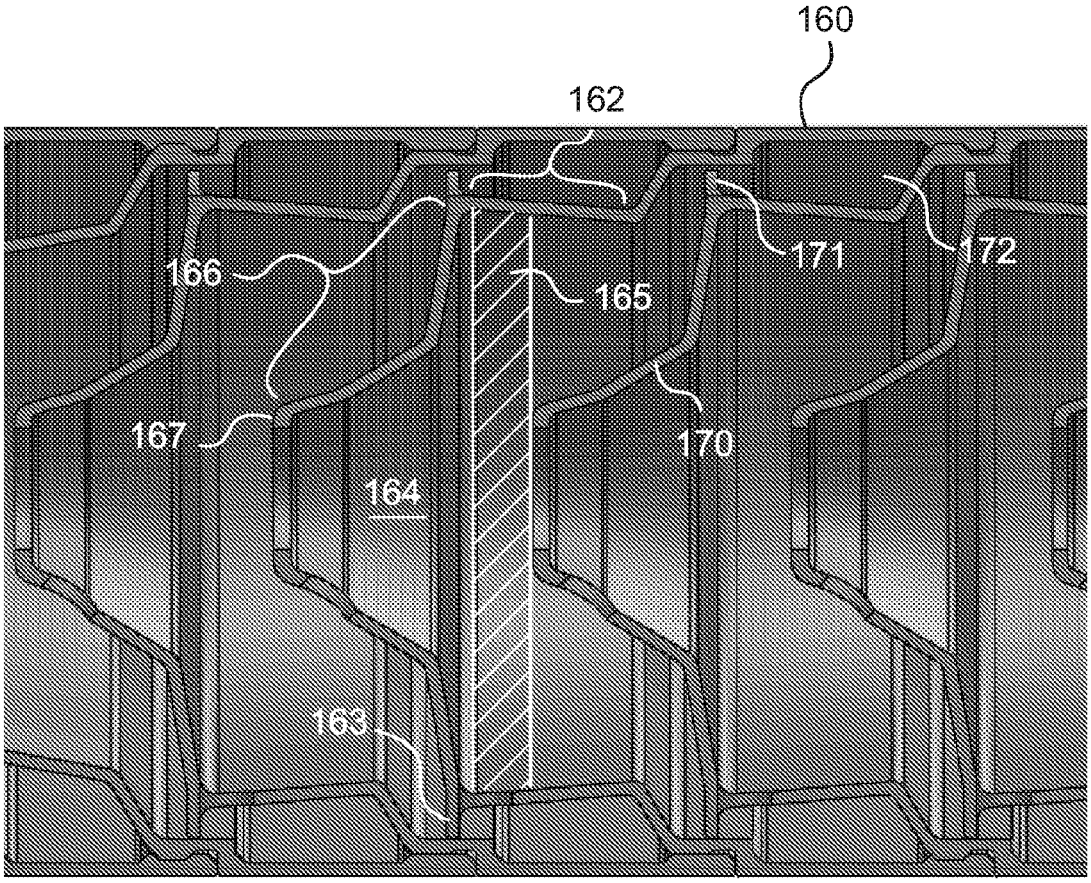
FIG. 10 is an enlarged diagrammatic cross-sectional side view of the baffle of FIG. 9.

Referring now to FIGS. 9-10, there is shown an alternate embodiment of a baffle 160 to be used in a firearm suppressor stack where the funnel shape and dimensioning is selected to cause greater initial expansion then more gradual compression of gasses in the primary chamber. The joined baffles of this type operate, for the most part, similarly to the joined baffles in the embodiment of FIGS. 1-8. However, the funnel 161 has a differently shaped medial section 162 distally adjacent to its circumferential flange 163 which gradually tapers as it extends distally. This tapering section has a substantially conical shape which narrows as it extends distally. Thus, the funnel structure first has a widening section 166 extending distally from the proximal end 167, and a medial section 162 which narrows as it extends distally from the widening section. The primary chamber 164 initially expands in the distal direction, then begin to contract in a contraction region 165 before the primary chamber reaches the axial position of the proximal end of the funnel of the next successive baffle 170. This narrowing allows for a more rapid initial widening of the funnel structure to help decrease pressure and then helps increase the pressure of the gasses being driven toward the port 171 leading to the secondary chamber 172.

Figure 11:
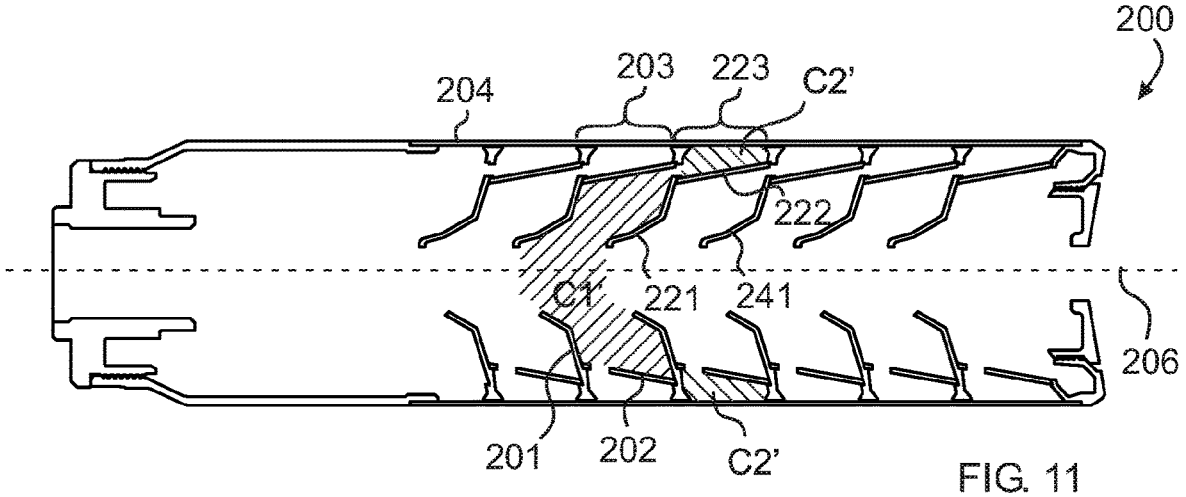
FIG. 11 is a diagrammatic cross-sectional side view of a firearm suppressor according to an alternate exemplary embodiment of the invention having baffles characterized by separate skirt and spacer features.
Figure 12:
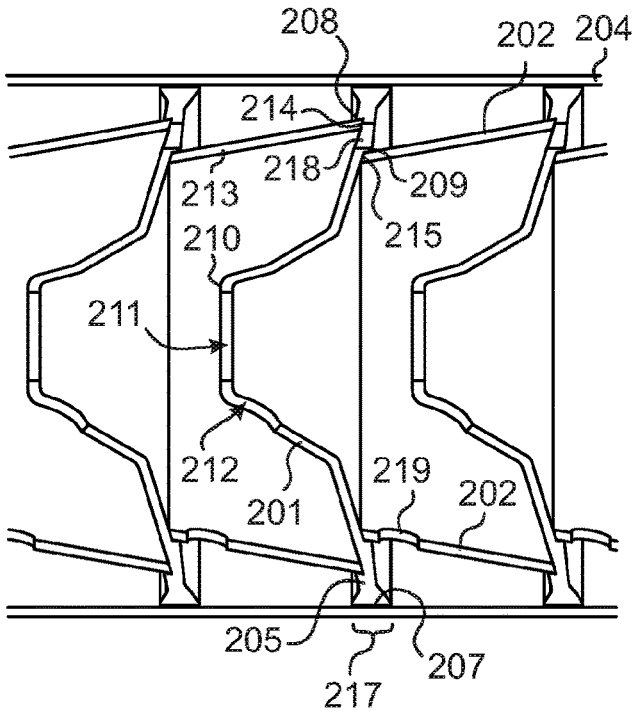
FIG. 12 is an enlarged diagrammatic cross-sectional side view of the suppressor of FIG. 11.

Referring now to FIGS. 11-12, there is shown an alternate embodiment of a firearm suppressor 200 where a baffle is formed by a two piece funnel structure made up of a skirt 201 and a spacer 202 mounted within a section 203 of a unitary outer tube 204. Successive skirts and spacers are mounted coaxially along an axis 206 to form a baffle stack. The outer tube can be cylindrical so that each skirt cam be substantially cymbal shaped, whereas each spacer can have a hollow truncated right circular cone shape having a proximal opening narrower than its distal opening.

As shown more clearly in FIG. 12, the proximal end 210 of the skirt 201 includes a central circular aperture 211 having a diameter selected to allow intimate axial passage of the projectile therethrough, forming part of the central bore of the suppressor. Optionally, an angular notch 212 can be formed radially through the funnel adjacent to the aperture. The skirt 201 can have a circumferential flange 205 at its distal end having a radially outward cylindrical periphery 207 bearing against the cylindrical inner surface of the outer tube 204. The flange can have and axially thickened flair 217 at its radial periphery in order to strengthen the contact between the skirt and the tube. The flange can have a proximally facing ridge 208 to provide a seat against the distal lip 214 of a proximally adjacent spacer 213. The flange can have a distally facing ridge 209 forming a seat against the proximal lip 215 of a distally adjacent spacer 202.

A port 218 extends axially through the circumferential flange 205 of the skirt 201 connecting primary and secondary chambers as will be described below. The size and number of ports can be selected to allow for channeling gasses more rapidly. A hole 219 extends radially through the spacer 202 to allow discharge of backpressure gasses in a fashion similar to the embodiment of FIGS. 1-8.

Referring back to FIG. 11, an adjacent pair of skirts 201,221 separated by a spacer 202 form the boundaries of a primary chamber C1'. An adjacent pair of skirts 221,241 separated by a spacer 222 and contained within a section 223 of the outer tube 204 form the boundaries of a secondary chamber C2'. Thus, the pair of chambers C1',C2' are formed by a pair of adjacent baffles.

The flow of gasses operate similarly to the embodiment of FIGS. 1-8. Referring now to FIG. 12, the port 218 can be located diametrically opposite the notch 212 so that hot, high pressure initial gasses are directed toward the port and on to the secondary chamber. Further, the hole 219 can be located diametrically opposite the port so that gasses in the secondary chamber have a more circuitous route into and eventually out of the secondary chamber into the next more distal primary chamber, giving time for those gasses to cool and depressurize.

The above-described suppressor embodiments can be readily augmented to be inserted into a sleeve to further strengthen the suppressor albeit at the expense of increased weight.

The discrete, but interconnected chambers can also help trap sound suppressing fluids, such as water or grease, if they are used, within the suppressor rather than those fluids being ejected out of the suppressor.

The above-described embodiment can accommodate high gas pressures without loss in report attenuation. In this way the suppressor can provide significant sound reduction while maintaining a very compact structure and minimal increase in backpressure. The bore does not need to closely match the projectile diameter as in some prior designs achieving similar report attenuation.

The above embodiment can operate more efficiently as pressure increases in that louder, higher pressure ammunition does not result in a linear increase in the loudness of the report. For example, the report of a .308 caliber rifle can be less than 3 dB louder than the report of a .223 caliber rifle using half as much gunpowder.

While the preferred embodiments of the invention have been described, modifications can be made and other embodiments may be devised without departing from the spirit of the invention and the scope of the appended claims.

What is claimed is:

1. A firearm suppressor for dissipating energy from discharge gasses as a result of a discharge by a firearm, said suppressor comprises:
- a first baffle comprising a first funnel structure;
- a second baffle comprising a second funnel structure;
- wherein said first and second baffles are joined end-to-end;
- wherein said first funnel structure comprises:
  - a proximal end and a distal end;
  - a central aperture near said proximal end;
  - a notch extending radially through said first funnel structure;
  - said notch being located at a first angular position adjacent to said aperture;
  - wherein said second funnel structure comprises:
  - a circumferential flange extending radially outward from a medial section of said second funnel structure; and,
  - a port extending axially through said circumferential flange at a second angular position;
- a third baffle comprising a third funnel structure;
- wherein said third baffle is joined end-to-end to said first baffle; and,
- wherein said circumferential flange is located at an axial position aligned with an overlap joint between said third baffle and said first baffle; and,
- wherein a gap is formed between a periphery of said circumferential flange and an inner surface of said first funnel structure.

2. The suppressor of claim 1, wherein said first and second angular positions are different from one another.

3. The suppressor of claim 2, which further comprises a hole extending radially through said second funnel at a third angular position different from said second angular position.

4. The suppressor of claim 3, wherein said hole is located axially distal to said flange.

5. The suppressor of claim 3, wherein said first angular position is about 180 degrees separated from said second angular position; and wherein said third angular position is about 180 degrees separated from said second angular position.

6. The suppressor of claim 1, wherein said first and second baffles are substantially identically shaped and dimensioned.

7. The suppressor of claim 1, which further comprises:
- said third baffle comprising a distal extent; and,
- said proximal end being located proximal to an axial position of said distal extent.

8. The suppressor of claim 1, wherein said first funnel structure comprises:
- a widening section extending distally from said proximal end; and,
- a narrowing section extending distally from said widening section.

9. The suppressor of claim 1, wherein said second funnel structure further comprises:
- a skirt; and,
- a tubular spacer comprising a proximal lip contacting said skirt and a distal lip contacting said second baffle.

10. A firearm suppressor for dissipating energy from discharge gasses as a result of a discharge by a firearm, said suppressor comprises:
- a first baffle;
- a second baffle;
- a third baffle;
- wherein said first, second, and third baffles are joined coaxially and sequentially to form a stack;

an outer tube surrounding said stack;
wherein said first baffle comprises:
a section of said outer tube;
a funneling structure which comprises:
a skirt comprising a proximal end and a central aperture at said proximal end;
a tubular spacer comprising a proximal lip contacting said skirt and a distal lip contacting said second baffle;
said skirt having a circumferential flange extending radially outward to contact said section of said outer tube;
a port extending axially through said circumferential flange; and,
a hole extending radially through said tubular spacer.

11. The suppressor of claim 10, wherein said hole is located diametrically opposite said port.

12. The suppressor of claim 10, wherein said circumferential flange comprises and axially thickened flair at its radial periphery.

13. The suppressor of claim 10, wherein said tubular spacer has a substantially truncated right circular cone shape wherein said proximal lip is diametrically smaller than said distal lip.

14. The combination of a bullet and a suppressor baffle, wherein said bullet comprises a cylindrical outer surface; said suppressor baffle comprises:
wherein said baffle comprises:
an outer tube section;
a funneling structure which comprises:
a proximal end and a distal end;
a central aperture at said proximal end commensurate with said outer surface;
said distal end sealed to said outer tube section;
a circumferential flange extending radially outward from a medial section of said funneling structure;
a port extending axially through said circumferential flange; and,
a hole extending radially through said funnel axially distal to said flange.

15. The combination of claim 14, wherein said hole is located diametrically opposite said port.

16. A firearm suppressor for dissipating energy from discharge gasses as a result of a discharge by a firearm, said suppressor comprises:
a first baffle comprising a first funnel structure;
a second baffle comprising a second funnel structure;
wherein said first and second baffles are joined end-to-end;
wherein said first funnel structure comprises:
a proximal end and a distal end;
a central aperture near said proximal end;
a notch extending radially through said first funnel structure;
said notch being located at a first angular position adjacent to said aperture;
a widening section extending distally from said proximal end; and,
a narrowing section extending distally from said widening section;
wherein said second funnel structure comprises:
a circumferential flange extending radially outward from a medial section of said second funnel structure; and,
a port extending axially through said circumferential flange at a second angular position.

17. The suppressor of claim 16, wherein said first and second angular positions are different from one another.

18. The suppressor of claim 17, which further comprises a hole extending radially through said second funnel at a third angular position different from said second angular position.

19. The suppressor of claim 18, wherein said hole is located axially distal to said flange.

20. The suppressor of claim 18, wherein said first angular position is about 180 degrees separated from said second angular position; and wherein said third angular position is about 180 degrees separated from said second angular position.

21. The suppressor of claim 16, wherein said first and second baffles are substantially identically shaped and dimensioned.

22. The suppressor of claim 16, which further comprises:
a third baffle comprising a third funnel structure;
wherein said third baffle is joined end-to-end to said first baffle; and,
wherein said circumferential flange is located at an axial position aligned with an overlap joint between said third baffle and said first baffle.

23. The suppressor of claim 22, wherein a periphery of said circumferential flange contacts an inner surface of said first funnel structure.

24. The suppressor of claim 22, wherein a gap is formed between a periphery of said circumferential flange and an inner surface of said first funnel structure.

25. The suppressor of claim 22, which further comprises:
said third baffle comprising a distal extent; and,
said proximal end being located proximal to an axial position of said distal extent.

26. The suppressor of claim 16, wherein said second funnel structure further comprises:
a skirt; and,
a tubular spacer comprising a proximal lip contacting said skirt and a distal lip contacting said second baffle.

* * * * *